US008801898B2

(12) United States Patent
Trolin et al.

(10) Patent No.: US 8,801,898 B2
(45) Date of Patent: Aug. 12, 2014

(54) METHOD AND ARRANGEMENT FOR ADDING TREATMENT LIQUORS TO CELLULOSE RAW MATERIAL IN A CONTINUOUS PROCESS USING DOWN FLOW VESSELS

(75) Inventors: Daniel Trolin, Camacari (BR); Fredrik Wilgotson, Karlstad (SE); Peter Henricsson, Sundsvall (SE)

(73) Assignee: Valmet AB, Sundsvall (SE)

( * ) Notice: Subject to any disclaimer, the term of this patent is extended or adjusted under 35 U.S.C. 154(b) by 103 days.

(21) Appl. No.: 13/390,341

(22) PCT Filed: Aug. 19, 2009

(86) PCT No.: PCT/SE2009/000383

§ 371 (c)(1), (2), (4) Date: Apr. 26, 2012

(87) PCT Pub. No.: WO2011/021968

PCT Pub. Date: Feb. 24, 2011

(65) Prior Publication Data

US 2012/0216971 A1 Aug. 30, 2012

(51) Int. Cl.
*D21C 7/00* (2006.01)

(52) U.S. Cl.
CPC ..... *D21C 7/00* (2013.01)
USPC ..... 162/17; 162/237

(58) Field of Classification Search
USPC ..... 162/17, 237
See application file for complete search history.

(56) References Cited

U.S. PATENT DOCUMENTS

| | | | |
|---|---|---|---|
| 3,434,920 | A | 3/1969 | Green |
| 3,881,986 | A | 5/1975 | Backlund |
| 4,120,748 | A | 10/1978 | Zucker |

FOREIGN PATENT DOCUMENTS

| | | |
|---|---|---|
| SE | 523850 | 5/2004 |
| SE | WO2006006934 | 1/2006 |
| SE | EP2065513 | 6/2009 |

*Primary Examiner* — Jacob Thomas Minskey
(74) *Attorney, Agent, or Firm* — Rolf Fasth; Fasth Law Offices

(57) ABSTRACT

The method and arrangement is for adding treatment liquor to comminuted cellulose material, preferably wood chips, during the manufacture of chemical pulp in a continuous process. The process uses a down-flow vessel where chips are descending down the vessel in a plug-flow and where treated chips are continuously fed out at the bottom of the vessel. By arranging more than two parallel pipes offset from the center of the vessel a better distribution of treatment liquor is obtained. Any disturbance of the chip plug flow descending down the vessel is reduced to a minimum.

2 Claims, 4 Drawing Sheets

FIG. 1 / *Prior Art*

METHOD AND ARRANGEMENT FOR ADDING TREATMENT LIQUORS TO CELLULOSE RAW MATERIAL IN A CONTINUOUS PROCESS USING DOWN FLOW VESSELS

PRIOR APPLICATION

This application is a U.S. national phase application that is based on and claims priority from International Application No. PCT/SE2009/000383, filed 19 Aug. 2009.

TECHNICAL FIELD

The present invention concerns a method and an arrangement for adding treatment liquors to comminuted cellulose material, preferably wood chips, during the manufacture of chemical pulp in a continuous process using a down flow vessel where chips are descending down the vessel in a plug flow.

BACKGROUND AND SUMMARY OF THE INVENTION

In old conventional Prior Art used cooking of chemical cellulose pulp with continuous digesters it was common to use a pre-treatment arrangement with a chip bin, steaming vessel and an impregnating chip chute, before the cooking process is established in the digester. Steaming has been carried out in one or several steps in the chip bin, prior to the subsequent formation of a slurry of the chips in an impregnation fluid or a transport fluid. The steaming has been considered to be absolutely necessary in order to be certain of expelling the air and water that is bound in the chips, such that the impregnation fluid can fully penetrate the chips, and such that air is not drawn into the system.

Attempts have been made to integrate the chip bin with the impregnation vessel in order to obtain in this manner a simpler system.

Already in U.S. Pat. No. 2,803,540, a system was revealed in which the chips from a chip bin were fed to a vessel in which a combined steaming and impregnation was achieved. In this vessel, the chips were steamed at the upper part of the vessel and impregnation fluid at the same temperature was added at various levels in the vessel using distributing annular manifolds/headers located outside of the vessel wall, and having nozzles penetrating the wall. These principles were also applied in a process known as "Mumin cooking", which is described in"Continuous Pulping Processes", Technical Association of the Pulp and Paper Industry, 1970, Sven Rydholm, page 144. In this process, unsteamed chips were passed to a combined impregnation vessel, where steaming was obtained in the upper part, and to which impregnation fluid was added at a point in the upper part of the vessel during forced circulation. The impregnation fluid was in this case carried exclusively in the same direction of flow as the chips.

A similar system with a low pressure first common steaming and impregnation vessel is shown in U.S. Pat. No. 3,532,594, which also was put into operation for example at the Skoghall mill in Sweden. Here was heated impregnation liquid added via a central pipe to the chip volume, but also showing an additional central pipe for steam supply. This system was later abandoned due to various reasons such as run ability problems, capacity problems in subsequent feeding system and far too high reject and shive content in the blown pulp.

A system is shown in U.S. Pat. No. 5,635,025 in which the chips are fed without prior steaming to a vessel in the form of a combined chip bin, impregnation vessel and chip chute. Steaming of the chips takes place here, the chips lying above the fluid level, and a simple addition of impregnation fluid takes place trough the vessel wall below the liquid level.

A further such system is revealed in U.S. Pat. No. 6,280,567, in which the chips are fed without prior steaming to an atmospheric impregnation vessel in which the chips are heated by the addition of warm black liquor that maintains a temperature around 130-140 C. The added impregnation liquid is added via nozzles in a manner similar to what is shown in U.S. Pat. No. 2,803,540, i.e. using supply nozzles penetrating the wall of the vessel.

An alternative system is revealed by SE 523.850 in which pressurized black liquor is added to the upper part of the steaming vessel, whereby the black liquor after being subjected to a pressure reduction releases steam for the steaming process. The addition of the hot black liquor is made by a horizontal supply pipe penetrating the chip bed, and having a multitude of holes over the length of the pipe. Even if the distribution of hot black liquor is made over a larger (but not over the complete cross-sectional) area this solution is not advisable since the horizontal pipe may hinder the chip plug movement. The prior art has mostly used either a central pipe or annular distribution nozzles for the added impregnation liquid to the combined steaming and impregnation vessel. During the last few years the design capacity of new digester systems has been significantly increased, from typically 500-2000 ADt/24 h to production rates over 5000 ADt/24 h. As the design production rate increases the combined chip steaming and impregnation vessel diameter increases as well. The fact that the diameter of the vessel increases and in combination with using prior art technology, the added treatment liquor may not be evenly distributed over the entire cross-sectional area of the vessel resulting in a chemical concentration gradient.

SE 523.850 discloses another solution to improve the distribution but it will then instead introduce a great risk for chip plug blockage.

Another disadvantage with a single central pipe for adding the treatment chemicals in larger treatment vessels is that the flow of chemicals is high and would be disruptive for a uniform plug flow movement in the lower part of the vessel.

Other disadvantages with only one central pipe for adding treatment chemicals are (1) the diameter of the central pipe becomes big in systems with high design capacity, which means that a hole with same diameter as the pipe is formed below the end of the central pipe which may continue all the way down to the bottom of the vessel, which in turn give rise to (chip and) liquor channeling, (2) that a huge quantity of the generated flash steam is introduced at one point, which could cause steam channeling around the central pipe due to the high velocity of the steam going counter-current the chip flow, which could result in steam blow-through of the chip pile.

A disadvantage with a distribution manifold outside of the vessel and supply nozzles penetrating the wall of the vessel for adding the treatment chemicals is, except additional requirement of control valves/instrumentation and pipes, thus increased cost, that it is difficult to completely distribute the chemicals from the shell side to the center of the vessel, thus there is an apparent risk for liquor channeling along the shell of the vessel. All these disadvantages may cause an uneven treatment of the chips, such that quite different pulp quality is produced from those plug flows being closest to wall or central pipe.

The technique with a common treatment vessel for steaming and impregnation at substantially atmospheric conditions is marketed by Metso Paper under the name of IMPBIN™. Several improvements of the concept have been patented in;

- SE 518.738 (=U.S. Pat. No. 7,381,302), with impregnation liquids added at successively increasing temperature at positions in IMPBIN with higher static head;
- SE 528.448 (=EP1818445), with liquor circulations of IMPBIN separated from those in digester;
- SE 530.725 (=EP2065513), with cooling showers in top of IMPBIN for knocking down blow trough of malodorous gases.

The above mentioned disadvantages with prior art addition of treatment liquors are made more obvious as sizes of these steaming and impregnation vessels of the IMPBIN type becomes bigger. The diameter of a typical cylindrical IMPBIN vessel for a digester system with capacity over 5000 ADT per day is well over 9 meter.

The principle object of the invention is to obtain an improved arrangement for the addition of treatment liquors to chips during the manufacture of chemical pulp in a continuous process using a down flow vessel where chips are descending down the vessel in a plug flow, which arrangement does not demonstrate the disadvantages that are associated with other known solutions as described above. This principal objective becomes more important in high capacity processes, with capacities of producing well over 4000 and as much as 6000 ADT/pulp per day, and where treatment vessels becomes huge and having diameters well over 9 meter.

A specific objective is to enable equal treatment of the wood material in the entire volume of the treatment vessel, minimizing variations in kappa number of the produced pulp and decreasing the amount of rejects (uncooked wood material) from the process. By an even initial distribution of alkaline black liquor, thus ensuring that the alkali concentration over the vessel's entire cross-section and volume will be sufficient, could also the chip volumes being exposed to extensive acidic pre hydrolysis be reduced, since acidic pre hydrolysis is negative for pulp strength properties and yield.

Another specific objective is to minimize channeling effects in the chip or wood material plug flow, which formations of channels or voids is almost impossible to avoid by using singular central pipes with large diameters according to conventional prior art. If such channels are formed inside of the treatment vessel, then most or a large part of the added treatment liquor may be by-passed the bulk flow of wood material intended to be treated in the treatment vessel.

Yet another specific objective is to decrease the steam velocity of the steam being flashed out from the hot treatment liquor, which per se reduces the risk for channeling and leakage of steam along the exterior surface of the supply pipes. By reducing the steam velocity will also the risk for blow-trough, i.e. steam being pushed up and through the entire chip volume, be reduced.

The invention can advantageously be used when cooking hard wood and softwood wood chips, bagasse and other annual plants.

The characteristics of the invention are defined by the independent claims, and optional embodiments are defined in dependent claims in order of dependency of preceding claims. The invention is also disclosed in a preferred embodiment, but any specific feature of this embodiment could as such be included in the invention optionally, if not specifically defined as a necessary feature for the argued effect.

DETAILED DESCRIPTION OF PREFERRED EMBODIMENTS

During following description will the term "treatment liquor" be used, and by this is meant one kind of treatment liquor that is intended to be added evenly to the entire chip flow in the treatment vessel. This treatment liquor could comprise only of spent cooking liquor, i.e. black liquor, from a subsequent digester, but could also be a mixture of two or more of following liquids;

- black liquor,
- fresh cooking chemicals such as white liquor (and additives e.g. antraquinon),
- dilution liquids from subsequent wash stage (i.e. wash filtrate from such wash stages),
- steam (added directly in order to heat the treatment liquor).

The term "treatment liquid" will also be used, and by this is meant the treatment liquid established in or withdrawn from the vessel, which besides partially used treatment liquor also contains chip moisture or any other organic or inorganic content dissolved from the chips.

The term "treatment vessel" will also be used, and by this is meant any kind of treatment vessel used for treating chips in either form of delignification or impregnation state, i.e. the vessel could be an atmospheric combined steaming and treatment vessel like IMPBIN, or a pressurized digester.

The term "comminuted cellulose material" be used, which preferably could be in form of wood chips, but also more fragmented wood material such as sawdust or pin chips, all obtained from either hardwood or softwood.

Figure 1:
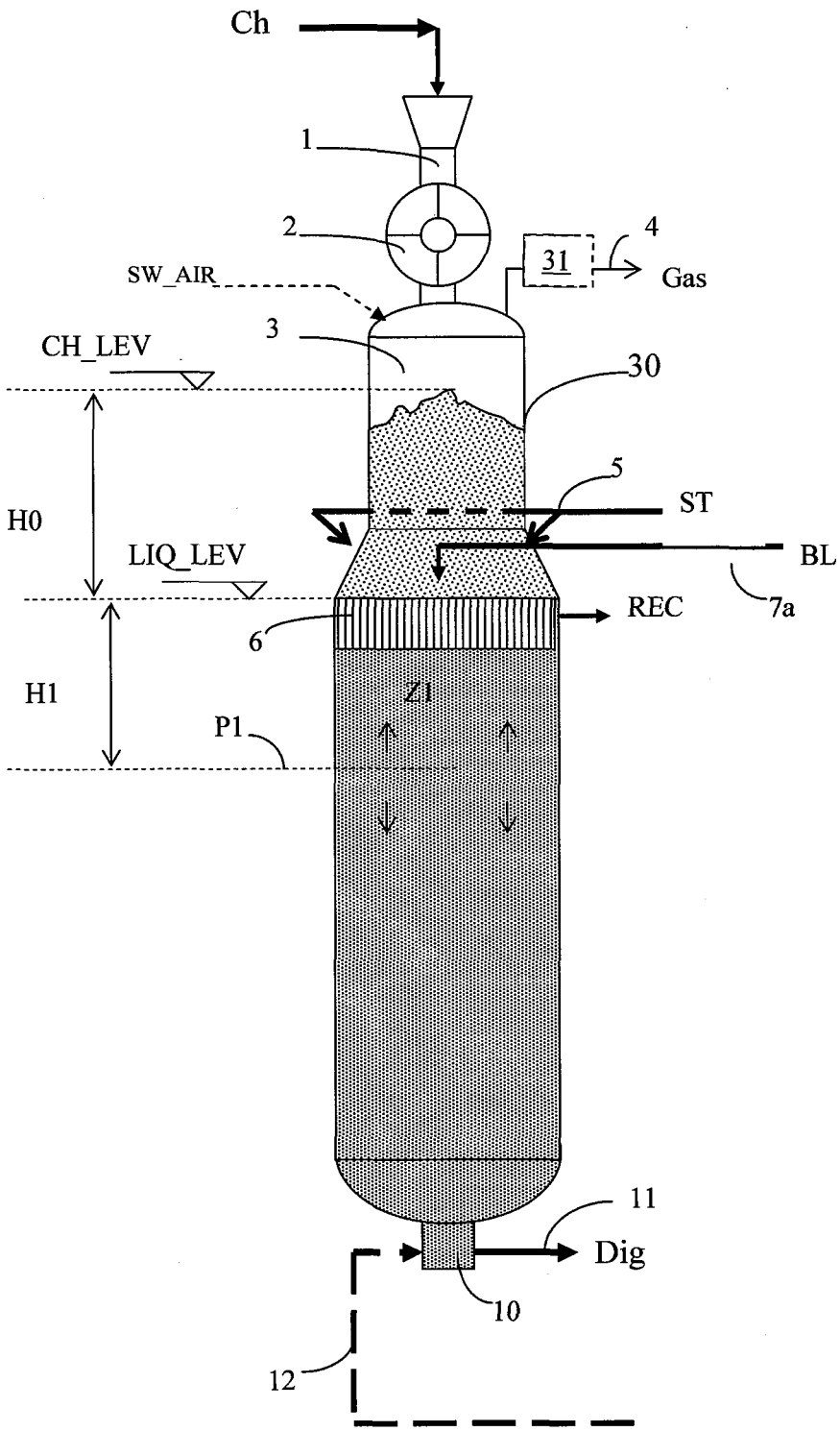
FIG. 1 shows an impregnation vessel according to state of the art.

A prior art arrangement for the impregnation of chips during the manufacture of chemical pulp is shown in FIG. 1, and is in all essential parts of the IMPBIN concept sold by Metso, including the method of wet-steaming chips in a substantially atmospheric pressure (±0.5 bar, i.e. not a pressure vessel). The arrangement comprises an essentially cylindrical impregnation vessel 30 arranged vertically into which unsteamed chips are continuously fed into the top of the impregnation vessel via feed means, in the form of a small chip buffer 1 without steaming and a chute feed (chip feed) 2. The chips that are fed into the impregnation vessel are thus unheated chips that normally have the same temperature as the ambient temperature.

The pressure in the vessel can be adjusted as necessary through a control valve 31 arranged in a valve line 4 at the top of the impregnation vessel, possibly also in combination with control of the steam ST via input lines 5.

When atmospheric pressure is to be established, this valve line can open out directly to the atmosphere. It is preferable that a pressure is established at the level of atmospheric pressure, or a slight deficit pressure by the outlet 4 of magnitude-0.5 bar (−50 kPa), or a slight excess pressure of magnitude up to 0.5 bar (50 kPa).

Input of a ventilating flow, SW_AIR (sweep air), can be applied at the top as necessary, which ensures the removal of any gases present or brought into the vessel by the in feed of comminuted cellulosic material.

The impregnated chips are continuously fed out via output means, here in the form of an outlet 10, possibly also in combination with bottom scrapers (not shown in the drawing), at the bottom of the impregnation vessel 30.

The level of the chips, CH_LEV, above the level of the liquid, LIQ_LEV, should preferably be at least 2 meters and preferably at least 5 meters when impregnating wood chips. In the case of pulping raw material of low density, a corresponding increase in the height of the column of chips over the surface of the fluid is preferably established. This height is important in order to provide an optimal passage of the chips in an even plug flow through the vessel.

When impregnating primarily easily cooked types of wood, such as eucalyptus and other annual plants, steaming with fresh steam can be essentially avoided. Fresh steam is thus not necessarily added to the chips that lie on top of the fluid level established by the impregnation fluid during normal steady-state operation. The invention can also be applied even if softwood with lower density is used as raw material, giving a markedly reduced need for steaming, that is, a reduced addition of fresh steam.

When treating primarily wood raw material that is difficult to cook, especially softwood having less density, and in operational cases with extremely low temperature of the chips, (such as during the winter), the chips that lie above the fluid level established by the impregnation fluid can be heated by the addition to the impregnation vessel of external steam ST such that a temperature of the chips approach 100° C. in the chip pile before the chips reach the fluid level that has been established by the treatment liquor The treatment liquor added via a common central pipe 7*a* can also be established as a mixture from totally separate sources, that is, not from one common flow of black liquor.

For example, the treatment liquor may also contain a wash filtrate.

The treatment liquor added can also be a mixture of black liquor and an additive amount of fresh cooking chemicals, i.e. white liquor, with the object of establishing alkali profiles that are necessary for the process. In particular if the residual alkali in the black liquor is low. A rapid initial consumption of alkali normally takes place, simply in order to neutralize the wood acidity, while it is desired to keep the final residual alkali after the impregnation stage at a certain level. The needed amount of additional alkali is mostly dependent on the level of wood acidity being released during steaming in the chip volume above the liquid level, and thus dependent on type of wood being treated (softwood or hardwood).

The vessel may be equipped without or with extraction screens to allow liquid extraction (REC) early in the process.

Figure 2:
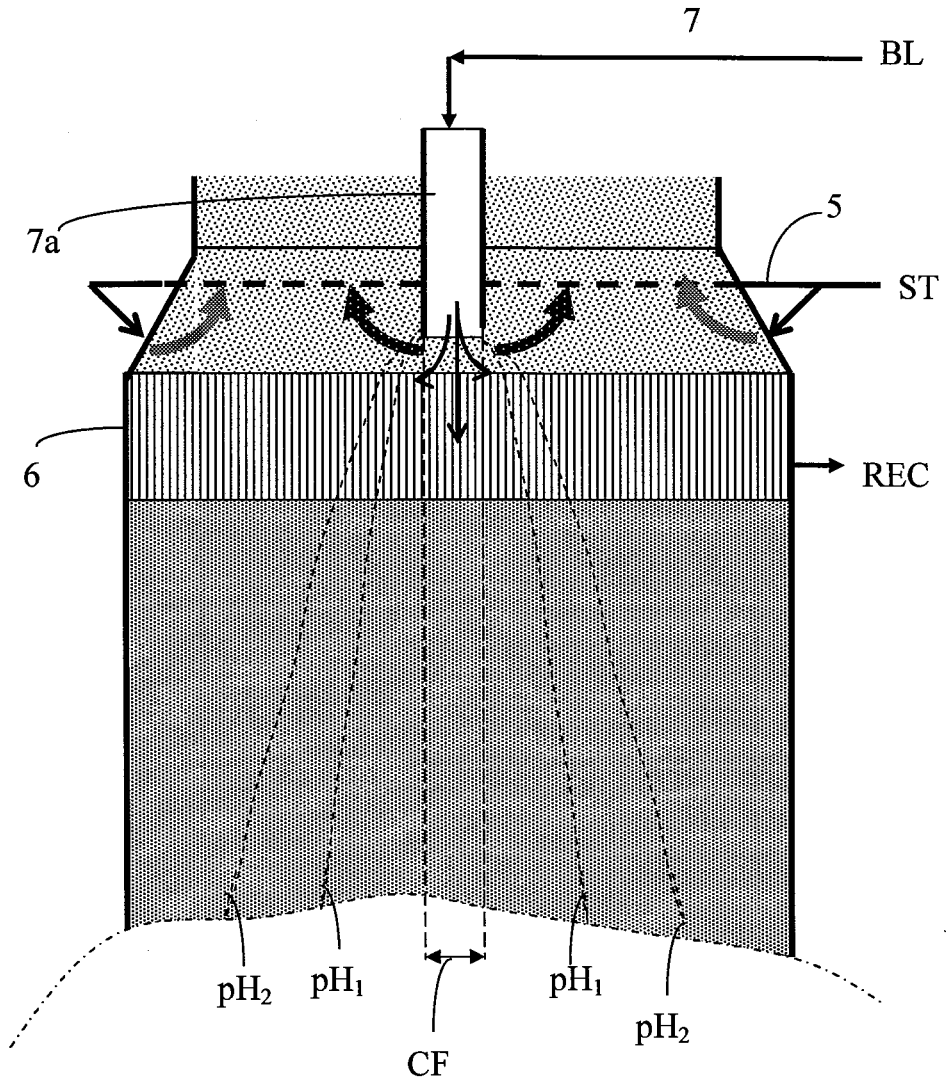
FIG. 2 shows a detail of a central pipe used in FIG. 1.

In FIG. 2 is a detail view of FIG. 1 of the area of addition of the treatment liquor BL via a single central pipe 7. As is disclosed here is the outlet from the central pipe 7 located above the liquid level, LIQ_LEV. The hot treatment liquor being added according to the wet-steaming concept is added to the center of the vessel as shown with downwardly directed arrows. The pressure in the chip pile at level of the outlet end of the central pipe is lower than the boiling pressure of the treatment liquor added, and the treatment liquor added will thus flash off steam as shown in darker upwardly directed arrows. Additional fresh and/or flash steam ST generated from an other heat recovery system (such as flash cyclone, re-boiler, heat exchanger etc.) could also be added at this height position dependent on need for such additional steam, and this flow of steam is shown in slightly less dark coloured upwardly directed arrows.

As shown here is the alkali profiling in the chip column indicated by pH boundaries, where $pH_1$ and $pH_2$ indicate different pH's established at each respective boundary line, and where the pH at $pH_1 > pH_2$.

Another effect of using a large central pipe for the supply of the treatment liquor is the formation of a larger hole or a less compacted central part of the chip plug descending down the vessel, and this area is marked by CF. This central part CF with less well packed chips could form a channel for the added treatment liquor that instead of being distributed to the entire chip volume is led quicker to the outlet end of the treatment vessel with less effective treatment time on the chips.

Figure 3:
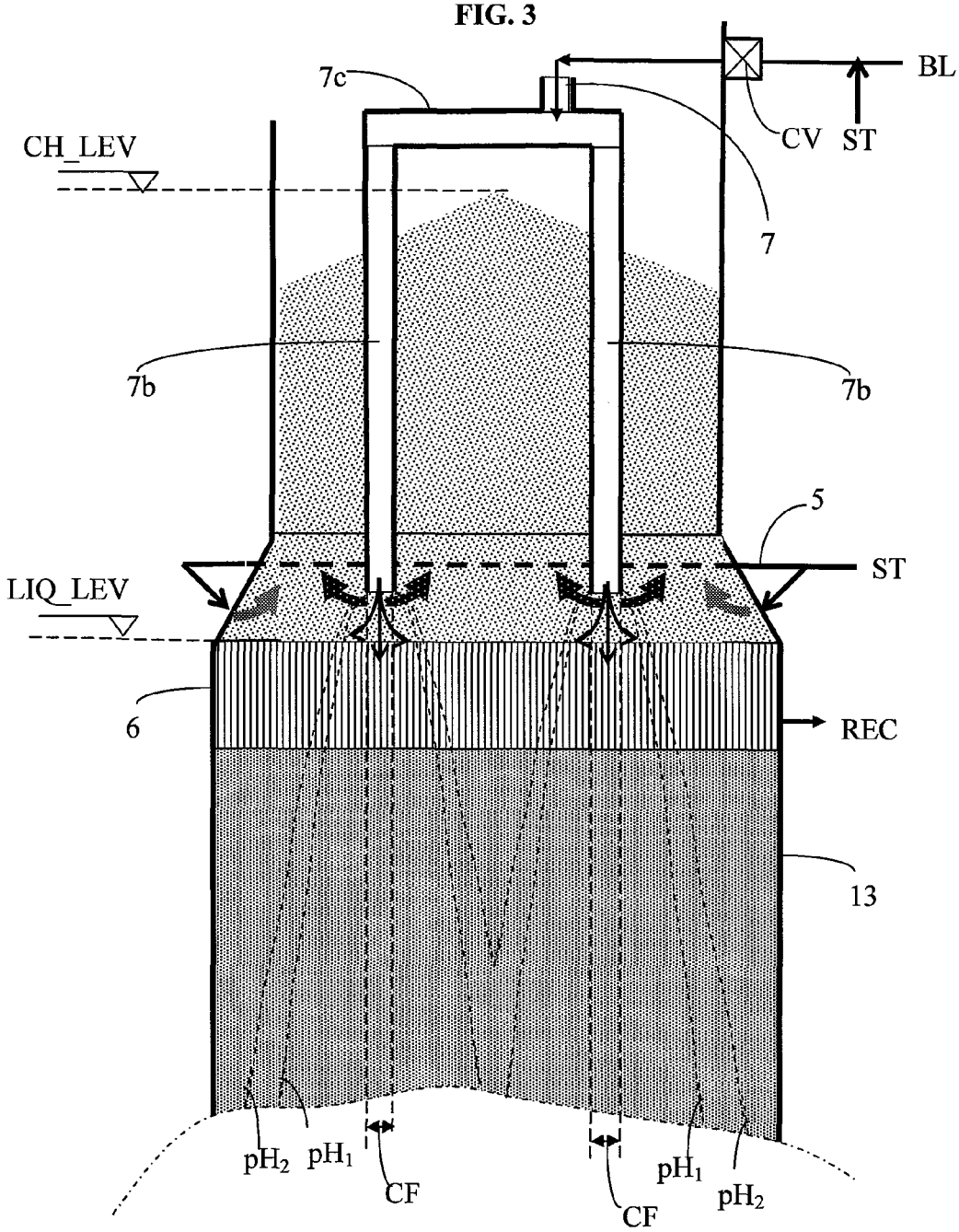
FIG. 3 shows an embodiment of the invention in a side view.

In FIG. 3 is a preferred embodiment of the invention shown, with emphasis on the improvements made in relation to the prior art design in FIG. 1. Here is shown an arrangement for adding the treatment liquor BL to comminuted cellulose material, preferably wood chips, during the manufacture of chemical pulp in a continuous process. Said process using a down flow vessel 13 where comminuted cellulose material is descending down the vessel in a plug flow and where treated comminuted cellulose material is continuously fed out at the bottom of the vessel, similar to what is intended in FIG. 1. The improvement here is that the treatment liquor BL is supplied from a common source BL via piping 7 to a common header 7*c*. More than 2 vertical pipes 7*b* are connected with their upper end to the common header 7*c* and having their open lower ends inserted in the chip plug flow. As further shown in a top view in FIG. 4 are the vertical pipes located at a radial position R1 in the treatment vessel being smaller than the radius R2 of the treatment vessel at the height of the open lower ends of the vertical pipes.

Figure 4:
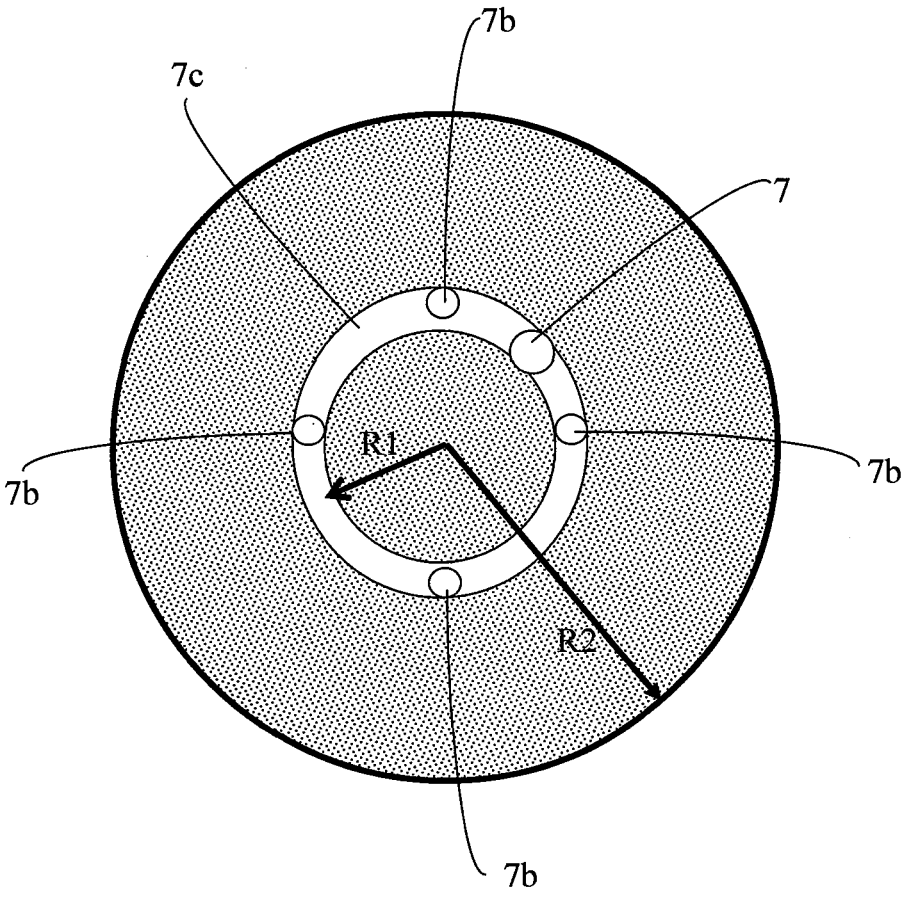
FIG. 4 shows FIG. 3 in a view from above.

As shown in FIG. 4 is preferably the common header 7*c* circular with a radius R1 and lying in a horizontal plane inside of the vessel. This will enable an undisturbed in feed of chips to the center of the vessel. The radius R1 is preferably within 20-80% of the radius R2, and more preferably within the range 50-66% of the radius R2. At the 50% location of R1 is the distance to the wall and the center of the vessel the same, and thus the displacement path equal in length. The 66% location of R1 corresponds to the "golden ratio", and where similar pulp volumes, due to the cylindrical form of the vessel, are to be displaced outwardly and inwardly in the radial direction from the point of addition by the added treatment liquor by. In an alternative embodiment could also the internal header be shaped as a "horse shoe", i.e. in a U-shaped form, instead of the circular distribution pipe shown in FIG. 4.

The vertical pipes 7*b* are connected to the common header 7*c* at even angular positions in the circumferential direction of the circular common header 7*c*.

Meaning that at least three vertical pipes 7*b* could be connected to the common header 7*c* at angular positions 120 degrees apart in the circumferential direction of circular header, or that at least four vertical pipes 7*b* could be connected to the common header 7*c* at angular positions 90 degrees apart in the circumferential direction of circular header, this latter version shown in FIG. 4.

As shown in FIG. 3 could a single control valve CV be arranged in the piping 7 outside of the treatment vessel 13, and preferably close to or preferably at the exterior wall of the treatment vessel. By such location could the pressure of the treatment liquor be maintained in the piping system up and until the wall of the treatment vessel, and any pressure reduction is only induced in piping located inside of the treatment vessel.

The common supply header could in an alternative embodiment (not shown) also be located outside of the vessel, and each individual vertical pipe 7*b* could be controlled by its own individual control valve.

As shown in the FIG. 3 could also, but not necessarily, a withdrawal strainer 6 be arranged in the wall of the treatment vessel, withdrawing a flow of treatment liquid from the treatment vessel, said withdrawal strainer being located at, above or below the open lower ends of the vertical pipes 7*b*. The need for any such withdrawal strainer is very much dependent on the alkali profiling of the entire process and type of wood.

The arrangement as shown thus provides a method for adding a treatment liquor to comminuted cellulose material, preferably wood chips, during the manufacture of chemical pulp in a continuous process using a down flow vessel where chips are descending down the vessel in a plug flow and where treated chips are continuously fed out at the bottom of the vessel and where the addition of the treatment liquor is made via 2 or more pipes being arranged parallel to plug flow direction, thus distributing the treatment liquor in parallel flows at multiple points over the plug flow area and reducing interference of the plug flow to a minimum.

According the inventive method it is preferred during steady state operations (i.e. excluding start and stop or occasional disturbances) that the fluid level in the vessel is established such that it lies under the level of the chips in the treatment vessel and that the outlets of the pipes are located above the fluid level but below the level of the chips in the treatment vessel. The inventive method utilize the wet steaming process where the temperature of the treatment liquor added via the 2 or more pipes at the position of the outlets exceeds the boiling temperature at the prevailing pressure close to the outlets, such that a flashing effect is obtained in the chip volume being located above the fluid level in the vessel. There is thus no need to use any flash tanks for flashing of steam and pressure from the black liquor withdrawn from the digester and the black liquor is instead flashed inside of the chip pile where the heating is required, and at no energy losses.

In a preferred but not necessary mode could according to the invention a withdrawal of treatment fluid take place at a position in the wall of the treatment vessel, inducing a radial displacement flow of treatment liquor from the outlets of the pipes and further trough the chips in the liquid volume.

Besides the shown embodiment with the addition of the treatment liquor made via 2 or more pipes being arranged parallel to plug flow direction, could also additional treatment liquor be added simultaneously via distribution nozzles arranged in the vessel shell, Tests In tests with a large diameter IMPBIN, similar to FIG. 1, without any withdrawal in a screen section 6, was surprisingly found that the pH level 5 meter below the liquid level was as low as 9.0, and this implies no residual alkali as a pH below 11 indicates no residual alkali. The test sample of the treatment liquid was withdrawn in a simple 25 mm stud outlet located at the 5 meter level. This low level at the wall of the IMPBIN was most surprising, as the residual alkali level in the chips being fed out from the treatment vessel was as high as 35 g/l when the alkali level of the treatment liquor supplied was 88 g/l.

When testing with a withdrawal volume of 1.5 $m^3$/BDT chips was instead a residual alkali level of about 2-5 g/l obtained in the withdrawn treatment liquid. However, still not as high as indicated by the residual alkali level in the chips being fed out from the treatment vessel.

These tests indicated the general alkali profiling throughout the vessel as shown in FIG. 2, indicating the boundaries $pH_1$ and $pH_2$ respectively and the need for better distribution of the treatment liquor throughout the entire plug flow.

While the present invention has been described in accordance with preferred compositions and embodiments, it is to be understood that certain substitutions and alterations may be made thereto without departing from the spirit and scope of the following claims.

The invention claimed is:

1. A method for adding a hot treatment liquor and steam to un-steamed comminuted cellulose material during a manufacture of chemical pulp in a continuous process, comprising:

providing a down-flow continuous treatment vessel having at least two vertical pipes being arranged parallel to a direction of a plug-flow of chips continuously descending down the vessel, the vertical pipes having open lower ends disposed below a chip level (CH_LEV) of the chips of a chip volume inside the treatment vessel, adding the treatment liquor via the at least two vertical pipes, the treatment liquor having a temperature exceeding a boiling temperature at a prevailing pressure at the outlets so that a flashing effect is obtained in the chip volume located above a liquid level (LIQ_LEV) established in the treatment vessel below the chip level (CH_LEV), distributing the treatment liquor in parallel flows and flashed steam at multiple points over a plug flow area with the at least two vertical pipes located at a radial position of a radius R1 in the treatment vessel, the radius R1 being smaller than a radius R2 of the treatment vessel at a height of the open lower ends of the two vertical pipes, reducing interference of the plug-flow to a minimum by distributing the treatment liquor via the at least two vertical pipes, locating the outlets of the open lower ends above the liquid level (LIQ_LEV) but below the level (CH_LEV) of the chips in the treatment vessel, and continuously feeding out treated chips at a bottom of the treatment vessel.

2. The method according to claim 1 wherein a withdrawal of the treatment liquor takes place at a position in a wall of the treatment vessel and inducing a radial displacement flow of treatment liquor from the outlets of the at least two vertical pipes and further through the chips in a liquid volume.

* * * * *